US007891402B2

(12) United States Patent
Keys, Sr. et al.

(10) Patent No.: US 7,891,402 B2
(45) Date of Patent: Feb. 22, 2011

(54) MOLD ASSEMBLY DEVICE AND METHOD FOR ASSEMBLING A SEMI-PERMANENT MOLD ASSEMBLY

(75) Inventors: John Keys, Sr., Chesaning, MI (US); James P. Bujouves, Saginaw, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 442 days.

(21) Appl. No.: 11/866,781

(22) Filed: Oct. 3, 2007

(65) Prior Publication Data

US 2009/0091057 A1 Apr. 9, 2009

(51) Int. Cl.
*B22C 9/10* (2006.01)
*B22D 33/04* (2006.01)

(52) U.S. Cl. ..... 164/30; 164/137; 164/340

(58) Field of Classification Search ..... 164/30–32, 164/119, 137, 306, 340
See application file for complete search history.

(56) References Cited

U.S. PATENT DOCUMENTS

| | | | | |
|---|---|---|---|---|
| 2,768,414 | A * | 10/1956 | Dolza | 164/31 |
| 2,783,510 | A * | 3/1957 | Dolza et al. | 164/137 |
| 5,423,372 | A * | 6/1995 | Kearney | 164/137 |

FOREIGN PATENT DOCUMENTS

| | | | |
|---|---|---|---|
| DE | 29609418 U1 | | 8/1996 |
| DE | 10302903 A1 | | 8/2004 |
| JP | 63-180360 | * | 7/1988 |
| JP | 64-53756 | * | 3/1989 |

* cited by examiner

*Primary Examiner*—Kuang Lin
(74) *Attorney, Agent, or Firm*—Fraser Clemens Martin & Miller LLC; J. Douglas Miller

(57) ABSTRACT

A mold assembly device and method for assembling a semi-permanent mold assembly is disclosed, the mold assembly device includes a base die and a transfer frame, wherein the transfer frame is capable of transferring a core package to the base die and facilitates assembly of the transfer frame and the core package with the base die.

8 Claims, 1 Drawing Sheet

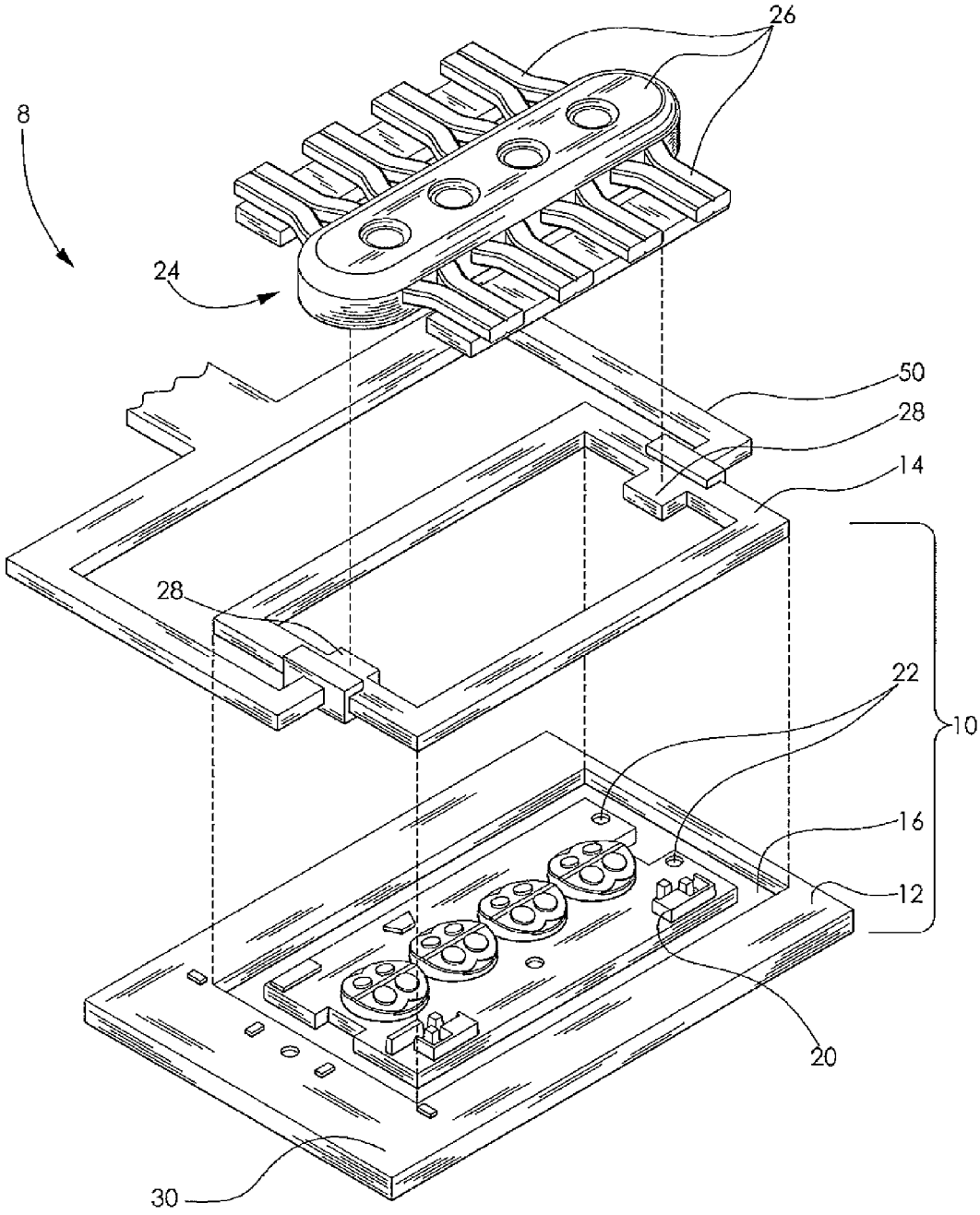
26
8
24
50
28
14
28
22
10
16
12
20
30

MOLD ASSEMBLY DEVICE AND METHOD FOR ASSEMBLING A SEMI-PERMANENT MOLD ASSEMBLY

FIELD OF THE INVENTION

The invention relates to a mold assembly device and more particularly to a mold assembly device including a transfer frame adapted to assemble cores with a die.

BACKGROUND SUMMARY

For purposes of illustration, reference will be made to the use of the present invention with respect to the casting of engine cylinder heads. It should be understood by those of ordinary skill in the art that the invention is not limited to use in casting engine cylinder heads and can be used in casting other products.

In a semi-permanent molding (SPM) process for casting of an aluminum internal combustion engine cylinder head, a metal die and an expendable core package are used. Unlike a sand mold in a sand casting process, the die can be used repeatedly to produce several castings. The die is adapted to permit rapid removal of the casting from the die and efficient positioning of a new core package. Typically, a coating or wash is applied to the die to mitigate against an adhesion of the casting thereto. The coating can by any conventional material such as an insulating material and a lubricious material, for example. The core package is disposed in the die to define internal and external surfaces of the engine cylinder head such as the intake and exhaust ports, water jacket, cam openings, and oil galleries, for example. The core package is formed by stacking a plurality of separate cores. Contrary to the permanent mold process (PM) which uses metal cores, the SPM process uses resin-bonded sand cores. Typically, the sand cores are formed by blowing resin-coated foundry sand into a core box and curing the sand therein.

Traditionally, the core package is disposed in the die by one of a manual process and an automatic process. The manual process involves assembling the core package within the die or outside of the die by an operator. The core package assembled outside of the die must then be transferred by the operator to the die and disposed therein.

In the automatic process, a fixture is typically used having a plurality of posts depending therefrom adapted to transfer the core package to the die and dispose the core package within the die. The posts include a plurality of balloon-like bladders adapted to be received in a plurality of apertures formed in the cores of the core package. In operation, the bladders are disposed in the apertures and caused to inflate, securing the fixture to the core package. Once the core package is disposed in the die, the bladders are caused to deflate and release the core package from the fixture. A problem with such a process is it is not feasible to form apertures for receiving the bladders in smaller and more complex cores.

It would be desirable to produce a mold assembly device capable of transferring a core package to a die and disposing the core package in the die, wherein the core package includes cores of varying sizes and complexity.

SUMMARY OF THE INVENTION

According to the present invention, a mold assembly device capable of transferring a core package to a die and disposing the core package in the die, wherein the core package includes cores of varying sizes and complexity, has surprisingly been discovered.

In one embodiment, the mold assembly device comprises a die adapted for use in a mold assembly; and a transfer frame joined with the die, the transfer frame adapted to receive a core package thereon, transport the core package to the die, and facilitate an assembly of the core package with the die.

In another embodiment, the mold assembly device for a semi-permanent mold assembly comprises a base die having a cavity formed therein; and a transfer frame received in the cavity of the base die, the transfer frame adapted to support a core package for transporting the core package to the base die and assembling the core package with the base die.

The invention also provides a method of assembling a mold package, comprising the steps of providing a base die adapted for use in a mold assembly; providing a transfer frame adapted to be received on the base die; assembling a core package with the transfer frame, the core package including at least one core; transferring the transfer frame and the core package to the base die; and assembling the transfer frame and the core package with the base die.

DESCRIPTION OF THE DRAWINGS

The above features of the invention will become readily apparent to those skilled in the art from reading the following detailed description of the invention when considered in the light of the accompanying drawing which is a fragmentary exploded perspective view of a partially assembled semi-permanent mold assembly with a mold assembly device according to an embodiment of the invention and showing a handling fixture for transporting the mold assembly device to the mold assembly.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical. For purposes of illustration, and not limitation, a core package for a four cylinder engine is shown. It is understood that the invention can be used with core packages for castings having different configurations and features if desired.

The drawing shows a partially assembled semi permanent mold (SPM) assembly 8 including a mold assembly device 10 according to an embodiment of the invention. The mold assembly device 10 includes a base die 12 and a transfer frame 14. The base die 12 can be produced from any conventional material such as H13 steel for example. Although the base die 12 shown is substantially planar and rectangular in shape, it is understood the base die 12 can have any shape or configuration as desired. The base die 12 is adapted to receive the transfer frame 14. In the embodiment shown, a cavity 16 is formed in the base die 12 to receive the transfer frame 14 therein. The cavity 16 has substantially the same shape as the transfer frame 14.

The base die 12 may also include protuberances 20 and apertures 22 adapted to cooperate with respective apertures and protuberances formed in a core package 24 to facilitate assembly, or to form respective cavities and protuberances in a casting (not shown).

In the embodiment shown, the transfer frame 14 is generally rectangular in shape having a pair of tabs 28 extending laterally inwardly towards a center portion of the transfer frame 14. It is further understood that the transfer frame 14 can have any shape as desired. Although the transfer frame 14 shown is produced from H13 steel, it is understood other conventional materials can be used as desired. In the embodiment shown, the transfer frame 14 is adapted to be removably received in the cavity 16 of the base die 12. As shown, an upper surface of the transfer frame 14 is substantially flush with an upper surface 30 of the base die 12. It is understood that the transfer frame 14 can be formed wherein the upper surface of the transfer frame 14 extends to a point above the upper surface 30 of the base die 12 or extends to a point below the upper surface 30 of the base die 12. Although the transfer frame 14 is substantially planer, it is understood that the transfer frame 14 may include at least one protuberance (not shown) formed thereon and at least one aperture (not shown) formed therein to facilitate an assembly or a use thereof.

The core package 24 includes one or more cores 26. Although the core package 24 shown includes an exhaust core, an intake core, an intake lightener core, and a water jacket core, it is understood that the core package 24 can include additional or fewer cores 26 as desired. In the embodiment shown, the cores 26 are produced from resin bonded sand. The resin bonded sand cores can be produced using any conventional core making processes such as phenolic urethane cold box and Furan hot box where a mixture of foundry sand and resin binder is blown into a core box and the binder is cured with either a catalyst gas or heat, respectively, for example. The foundry sand can include silica, zircon, fused silica, and other materials, as desired. It is further understood that other core types and materials can be used as desired.

In operation, the transfer frame 14 is typically separated from the base die 12 of the mold assembly device 10. The cores 26 are assembled on the transfer frame 14, which is adapted to receive the core package 24 thereon, to form the core package 24. The transfer frame 14 and the core package 24 are transferred by a handling fixture 50 to the base die 12. Any conventional handling fixture 50 such as opposed articulating grip pads, expanding mandrels inserted into female features of the transfer frame 14, and a crane, for example, can be employed as desired. As used herein, the handling fixture 50 may also include an assembly device, a robotic end-effector, and the like, which can be manual or automatic. The handling fixture 50 is employed to assist in transferring the transfer frame 14 to the base die 12 of the mold assembly device 10 and assembling the transfer frame 14 and the core package 24 with the base die 12. Additional core packages 24 can then be transferred and assembled with the base die 12, other dies can be assembled with the base die, or the transfer frame 14, the core package 24, and the base die 12 assembly can proceed to a casting operation. The operation is then repeated as desired for additional core packages.

Use of the transfer frame 14 with the core package 24 and the base die 12 facilitates a transfer and an assembly of various types and sizes of cores 26 and core packages 24 in an economic and efficient manner. Damage to the cores 26 and the core packages 24 is also minimized by minimizing a handling thereof.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A mold assembly device for a semi-permanent mold assembly comprising:

a base die having a cavity formed therein; and a transfer frame adapted to support a core package having a substantially planar lower surface, wherein the transfer frame is removeably seated in the cavity of the base die and circumscribed by the base die to militate against movement of the transfer frame within the cavity of the base die, and wherein the transfer frame cooperates with a handling fixture for transporting the core package to the base die and assembling the core package with the base die, wherein an upper surface of the base die is substantially flush with an upper surface of the transfer frame.

2. The mold assembly device according to claim 1, wherein the core package includes at least one core.

3. The mold assembly device according to claim 2, wherein the core package includes at least one of an exhaust core, an intake core, an intake lightener core, and a water jacket core.

4. The mold assembly device according to claim 2, wherein the at least one core is a resin bonded sand core.

5. A method of assembling a mold package, the method comprising the steps of:

providing a base die adapted for use in a mold assembly, the base die having a cavity formed therein;

providing a transfer frame having a substantially planar lower surface, wherein the transfer frame is shaped to be removeably seated in the cavity formed in the base die and circumscribed by the base die to militate against movement of the transfer frame within the cavity of the base die, and wherein the transfer frame is adapted to cooperate with a handling fixture;

assembling a core package with the transfer frame, the core package including at least one core;

transferring the transfer frame and the core package to the base die with the handling fixture; and disposing at least a portion of the transfer frame with the core package in the cavity of the base die, wherein an upper surface of the base die is substantially flush with an upper surface of the transfer frame.

6. The method of assembling the mold package according to claim 5, wherein the mold assembly is a semi-permanent mold assembly.

7. The method of assembling the mold package according to claim 5, further comprising the step of providing the mold package with at least one of an exhaust core, an intake core, an intake lightener core, and a water jacket core.

8. The method of assembling the mold package according to claim 5, further comprising the step of providing the mold package with at least one resin bonded sand core.

* * * * *